United States Patent [19]

Baatz et al.

[11] 4,073,994

[45] Feb. 14, 1978

[54] ACID MODIFIED POLYVINYL ACETATE TEXTILE SIZES

[75] Inventors: James C. Baatz, West Springfield; Donald D. Donermeyer, Springfield, both of Mass.

[73] Assignee: Monsanto Company, St. Louis, Mo.

[21] Appl. No.: 777,381

[22] Filed: Mar. 14, 1977

[51] Int. Cl.[2] ..... B05D 3/02

[52] U.S. Cl. ..... 428/265; 260/17.4 ST; 260/29.6 WA; 260/874; 260/901; 428/245; 428/264; 526/303

[58] Field of Search ..... 260/29.6 WA, 17.4 ST, 260/874, 901; 526/303; 428/245, 264, 265

[56] References Cited

U.S. PATENT DOCUMENTS

| | | | |
|---|---|---|---|
| 3,919,449 | 11/1975 | Corey et al. | 428/245 |
| 3,931,087 | 1/1976 | Baatz et al. | 260/29.6 G |

*Primary Examiner*—James J. Bell

*Attorney, Agent, or Firm*—R. Bruce Blance; William J. Farrington; James C. Logomasini

[57] ABSTRACT

Acid modified vinyl acetate interpolymers containing 2-acrylamido-2-methylpropanesulfonic acid and their use as textile sizes. The interpolymers comprise from about 64.5 to about 95.8 weight percent of vinyl acetate, from about 4 to about 9.5 weight percent of acrylic acid, from about 0.2 to about 1 weight percent of 2-acrylamido-2-methylpropanesulfonic acid and from about 0 to about 25 weight percent of an ethylenically unsaturated monomer selected from the group consisting of alkyl acrylates, dialkyl maleates, and dialkyl fumarates. The interpolymers are prepared preferably by latex polymerization. The textile size solutions are formed by dissolving the interpolymers in dilute aqueous bases or in an organic solvent, and can be used advantageously in combination with polyvinyl alcohol and starches. The sizes demonstrate excellent adhesion to spun polyester and spun blends of polyester and natural fibers and are readily removed by aqueous scouring solvents.

12 Claims, No Drawings

ACID MODIFIED POLYVINYL ACETATE TEXTILE SIZES

BACKGROUND OF THE INVENTION

1. Field of the Invention

The present invention relates to interpolymers of vinyl acetate and their use as textile sizes. More particularly, it relates to acid modified interpolymers of vinyl acetate containing 2-acrylamido-2-methylpropanesulfonic acid and to textiles, especially spun polyester textiles, sized with these interpolymers.

2. Description of the Prior Art

In conventional loom operations, yarn is sized with an aqueous solution of a water-soluble material woven into cloth on a conventional loom with a mechanical shuttle and then the size is removed in a water bath. Many water-soluble compositions are used as textile sizes, for example, poly(vinyl alcohols), carboxymethyl cellulose, starch, styrene-maleic anhydride copolymers, acrylic copolymers and vinyl acetate copolymers. While these sizes have been adequate for natural textile fibers and for many of the synthetic textile fibers, they exhibit deficiencies in the sizing of yarns of spun polyester and spun polyester blended with natural fibers. Poly(vinyl alcohols) lack ease of removability from the sized yarn and are difficult to recover or eliminate from the waste stream. Carboxymethyl cellulose is low in sizing efficiency and difficult to recover from the waste stream. Starch is similar to carboxymethyl cellulose in sizing efficiency and recoverability and is a stronger pollutant because it has a high biochemical oxygen demand. Styrene-maleic anhydride copolymers are deficient in adhesion to spun polyester, being easily shed, leaving the textile fiber unprotected. Acrylic copolymer sizes have good adhesion but are deficient in strength and low in efficiency. Vinyl acetate copolymers are, in general, low in efficiency, and lack ease of removability from the sized yarn.

U.S. Pat. No. 3,919,449 discloses acid-modified poly(vinyl acetate) textile sizes and textiles sized therewith. The sizes comprise interpolymers of 90.5 to 95.5 percent by weight vinyl acetate, 4.0 to 7.5 percent by weight acrylic acid and 0.5 to 2.0 percent by weight of a monoalkyl ester of maleic, fumaric, or citraconic acids. They are used for sizing spun polyester and spun blends of polyester and natural fibers.

The latex interpolymers of U.S. Pat. No. 3,919,449 are prepared by redox polymerization with a two component initiator system in the temperature range of 40° to 60° C. and more preferably, at a temperature in the range of 40° to 45° C. in order to produce interpolymers of sufficient molecular weight to provide adequate strength to the polymer. While these latex interpolymers provide a considerable improvement over prior art interpolymers of vinyl acetate in adhesion to spun polyester yarn and in ease of removability, a need exists for a further improvement in ease of removability. Furthermore, the process of interpolymerization while it is characterized by a low degree of coagulum, can be troublesome in commercial production because of the difficulty of controlling the polymerization at the relatively low temperatures in the range of 40° to 60° C. and because the coagulum can cause filtering problems and kettle fouling.

SUMMARY OF THE INVENTION

The present invention provides acid-modified poly(vinyl-acetate) textile sizes which, applied to the yarn as the salt of a monovalent cation, provide sized yarns suitable for use on conventional looms. The textile sizes of the present invention have excellent solubility characteristics, film properties and adhesion to a variety of yarns including spun polyester and polyester fiber blends. Moreover, these sizes are easily removed from sized yarns or the resulting fabric using water or aqueous solutions of inorganic or organic monovalent bases and are readily recovered from the wash solution.

One embodiment of the invention comprises an interpolymer comprising from about 64.5 to about 95.8 weight percent of vinyl acetate, from about 4.0 to about 9.5 weight percent of acrylic acid, from about 0.2 to about 1 weight percent of 2-acrylamido-2-methylpropanesulfonic acid and from about 0 to about 25 weight percent of an ethylenically unsaturated monomer selected from the group consisting of alkyl acrylates, dialkyl maleates and dialkyl fumarates wherein the alkyl group contains from 1 to 8 carbon atoms and the use of the interpolymer in textile sizing solution. The textile sizing solution may also comprise a water soluble vinyl alcohol interpolymer or a starch.

Another embodiment of the invention comprises the preparation of the textile sizing solution by interpolymerizing from about 64.5 to about 95.8 weight percent of vinyl acetate, from about 4.0 to about 9.5 weight percent of acrylic acid, from about 0.2 to about 1 weight percent of 2-acrylamido-2-methylpropane-sulfonic acid and from about 0 to about 25 weight percent of an ethylenically unsaturated monomer selected from the group consisting of alkyl acrylates, dialkyl maleates and dialkyl fumarates, at a temperature in the range of about 65° to about 100° C. in a latex polymerization system comprising a surfactant phosphate ester of an alkyl phenol ethylene oxide condensate wherein the alkyl group contains 7 to 11 carbon atoms, and dissolving the resulting latex in a basic aqueous medium.

Another embodiment of the invention comprises a process of sizing textile materials by applying to the textile material a textile sizing solution comprising the above-described interpolymer and another embodiment of the invention comprises textile materials coated with sizes comprising the above-described interpolymer.

PREFERRED EMBODIMENTS

The sizes of the present invention are prepared by interpolymerizing vinyl acetate, acrylic acid, 2-acrylamido-2-methylpropanesulfonic acid and optionally an alkyl acrylate, dialkyl maleate or dialkyl fumarate in which the alkyl groups contain from 1 to 8 carbon atoms. The interpolymers comprise from about 64.5 to about 95.8 weight percent of vinyl acetate, from about 4.0 to about 9.5 weight percent of acrylic acid, from about 0.2 to about 1 weight percent of 2-acrylamido-2-methylpropanesulfonic acid and from about 0 to about 25 weight percent of an ethylenically unsaturated monomer selected from the group consisting of alkyl acrylates, dialkyl maleates, and dialkyl fumarates wherein the alkyl groups contain from 1 to 8 carbon atoms. Thus, the total acid monomer is in the range from about 4.2 to about 10.5 percent by weight. Below about 4.2 percent by weight, the solubility or rate of solution of the interpolymer is unsatisfactory while above about 10.5 percent the interpolymer tends to lack water resistance.

It is a feature of the present invention that while the acid monomers of the interpolymer are preponderantly acrylic acid, a minor fraction comprises 2-acrylamido-2-methylpropanesulfonic acid (AMPS). This minor fraction of AMPS has been found to impart improved solubility and improved rate of solution to the interpolymer composition thus improving the efficiency of removal of the interpolymer size from woven goods, when the size is used as a warp yarn size. This improved solubility is achieved with from about 0.2 to about 1 weight percent AMPS per 100 parts by weight of interpolymer. Contrary to expectation, the AMPS is conveniently added in its entirety at the beginning of the polymerization while the other co-monomers are added incrementally throughout the polymerization. Additionally, this minor fraction of AMPS has been found to decrease substantially the amount of coagulum formed during the interpolymerization, improving the rate of filtration to remove the coagulum and decreasing the amount of kettle fouling which can occur when coagulum accumulates on kettle walls and lines.

While the interpolymer sizes of the present invention can comprise vinyl acetate, acrylic acid and AMPS, it has been found convenient to include up to 25 weight percent of a flexibilizing comonomer selected from the group consisting of alkyl acrylates, dialkyl maleates and dialkyl fumarates wherein the alkyl groups contain from 1 to 8 carbon atoms to provide a more water resistant, tougher textile size. Such flexibilizing comonomer is selected from the group which includes methyl acrylate, ethyl acrylate, n-butyl acrylate, isobutyl acrylate, n-octyl acrylate, 2-ethylhexyl acrylate, dimethyl maleate, di-n-butyl maleate, di-n-octyl maleate, di-2-ethylhexyl maleate, dimethyl fumarate, diethylfumarate and di-2-ethylhexyl fumarate.

The monomers are preferably polymerized using latex polymerization methods at a temperature in the range of from about 65° to about 100° C., preferably at a temperature in the range of from 75° to 85° C. and even more preferably at reflux temperature so that the exotherm of polymerization is controlled by the latent heat of evaporation and so that the vapors of the interpolymerization mixture provide an inert blanket over the batch excluding oxygen without the need for a nitrogen purge. At temperatures below about 75° C. the polymerization rate may be too slow and the reaction mass tends to coagulate. The molecular weight of the interpolymer should be such that the specific viscosity of a 1 percent solution of the interpolymer in dimethyl sulfoxide at 25° C. is in the range from about 1.5 to about 12.0 and more preferably, for adequate strength and solubility, it should be such that the specific viscosity is in the range from 1.8 to 6.0. Solubility is determined by the solution rate of a film of interpolymer as described herein.

The interpolymerization is carried out using a surfactant which comprises a phosphate mono- or di-ester of an alkyl phenolethylene oxide condensate wherein the alkyl group contains from 7 to 11 carbon atoms. Especially preferred are the phosphate mono-esters of tertiary octyl phenolethylene oxide condensates (hereinafter referred to as PEOPEO) and the phosphate mono-esters of nonyl phenolethylene oxide condensates (PENPEO). These preferred surfactants are available commercially as Triton XQS surfactants (Rohm and Haas Company) and GAFAC surfactants (General Aniline and Film Company), respectively. The amount of the phosphate ester of an alkyl phenol-ethylene oxide condensate used will be in the range of from about 0.5 to about 4.0 percent by weight based on the total weight of the latex.

In a more preferred embodiment of the invention, the latex interpolymerization of the monomers is carried out using an anionic co-surfactant in combination with the phosphate esters of an alkyl phenolethylene oxide condensate. The use of the co-surfactant further reduces the amount of coagulum in the resulting latex and provides a better product. The preferred co-surfactants used in the present invention include alkyl sulfonates such as sodium dodecyl benzene sulfonate, fatty alcohol sulfates such as sodium lauryl sulfate, dialkyl sulfosuccinates such as sodium dihexyl sulfosuccinate, etc. The amount of co-surfactant used is in the range of about 0.3 to about 1.0 percent by weight and more preferably about 0.40 to about 0.60 percent by weight based on the total weight of the latex. The co-surfactant is preferably added continuously during the polymerization reaction.

The latex polymerization processes are initiated by free radical initiators which have a rate of decomposition at the temperature of interpolymerization sufficient to give an adequate but not excessive rate of polymerization. Such initiators include inorganic peracid salts such as ammonium, potassium and sodium persulfates and perborates and hydrogen peroxide, organic peroxides and hydroperoxides such as benzoyl peroxide and t-butyl hydroperoxide and azo compounds such as azobis(isobutyronitrile).

The solids contents of the interpolymer latices can be varied over a wide range, the preferred latices having a solids content in the range of from 15 to 65 percent by weight and more preferably from 35 to 55 percent by weight, based on the total weight of the latex.

During the polymerization reaction, a conventional base such as ammonium hydroxide or sodium hydroxide is used to buffer the latex to a pH in the range of about 4.0 to about 6.0.

A textile sizing solution may be prepared from the interpolymer latex in several ways. In one method, an aqueous solution of base is mixed with the latex to dissolve the interpolymer by formation of the water soluble interpolymer carboxylate. Suitable bases include the hydroxides, carbonates and bicarbonates of alkali metals such as sodium hydroxide, sodium carbonate and sodium bicarbonate; ammonia; organic bases such as methylamine, dimethylamine, trimethylamine, ethylamine, diethylamine, triethylamine, morpholine, etc. The preferred base in the preparation of a loom finish size is ammonium hydroxide since it contributes to good adhesion and resistance to water, water spotting and dry cleaning. The preferred base in the preparation of removable warp yarn size is sodium carbonate since it contributes to rapid solution of the interpolymer, good adhesion of the interpolymer size to spun polyester yarn and rapid removability of the size from the woven goods. A particular advantage of the interpolymer latex is that the fine size of the interpolymer particles allows rapid solubility of the interpolymer in aqueous base to form the sizing solution which preferably should have a concentration in the range of about 1 to about 25 percent solids by weight and a viscosity in the range of about 500 to 2000 centipoises at 25° C. for ease of application to the yarn.

Another method for preparation of textile sizing solution comprises the recovery of the interpolymer from the latex by conventional means and solution of the interpolymer in an organic solvent. The size is then applied to the textile yarn as an organic solution and may be removed from the woven goods with aqueous base or organic solvent.

Preferred organic solvents for preparation of sizing solutions and removal of size are alcohols, ketones, esters and aromatic solvents. Especially preferred are chlorinated aliphatic hydrocarbons such as methylene chloride, methylene bromide, chloroform, bromoform, ethylene dichloride, ethylene dibromide, ethylidene chloride, ethylidene bromide, s-tetra-chloroethane, hexachloroethane, s-dichloroethylene, trichloroethylene, trimethylene bromide, trichlorobromoethane, trichloromethane, 1,2,3-tribromoethane, trifluoro-1,1,2-trichloroethane, 2,2-dichloro-1-bromoethane, 1,3-dichloro-2-methylpropane, 1,2-dichloro-2-methylpropane, 1,1-diiodoethane and the like. Chlorinated aliphatic liquid hydrocarbons are preferred in the practice of this aspect of the invention because of their generally lower cost, greater availability, nonflammability, low toxicity and ease of recovery.

A further advantage of the interpolymer compositions lies in their recoverability. The aqueous solutions of the interpolymer obtained by scouring of the sized goods are acidified with strong acid to a pH less than about 3.5. The interpolymer is precipitated and recovered by conventional means such as filtration or centrifugation. It is then dissolved in aqueous alkaline solution or organic solvent to form fresh sizing solution.

It is frequently advantageous to use the interpolymer composition as the major component of the textile size, formulated with conventional adjuncts such as lubricants, defoamers, humectants and plasticizers. The interpolymer composition can also be used in aqueous solution in combination with other water soluble polymers and resins in a ratio of from about 95:5 to 5:95 parts by weight and more preferably 75:25 to 25:75 parts by weight. Water soluble polymers and resins include the polyvinyl alcohols, and water dispersible starches conventionally employed in textile sizing solutions. The concentration of the interpolymer polymer combination in the aqueous sizing solution is generally in the range of about 1 to about 25 percent and preferably selected so that the viscosity at 25° C. is in the range of about 500 to about 2000 centipoises.

Useful polyvinyl alcohols are obtained from polyvinyl acetates hydrolyzed in the range of about 88 to about 98 weight percent, and are of molecular weight in a range such that a 4 weight percent solution in water at 20° C. has a viscosity in the range of about 40 to about 90 centipoise. Advantages of the combination comprising the interpolymer composition and a polyvinyl alcohol are derived from the improved adhesion particularly to polyester yarns, the improved removability and the improved economics attributable to the interpolymer composition and the higher viscosity of the sizing solution and the higher tensile strength of the combination attributable to the polyvinyl alcohol.

Water dispersible starches which can be used in combination with the interpolymer are pearl starches and acid hydrolyzed starches of low to moderate fluidity, hydroxyalkylstarches, and carboxymethylstarches. In such combination, the interpolymer composition imparts improved adhesion particularly to polyester yarns, and improved flexibility and improved removability while the starch reduces the cost of the sizing composition.

The following examples are set forth in illustration of the present invention and should not be construed as a limitation thereof. Unless otherwise indicated, all parts and percentages given are by weight.

PART A — PREPARATION OF LATICES

EXAMPLE 1

A latex is prepared in a conventional latex polymerization kettle equipped with an agitator, a heating and cooling system and a condenser. The charges listed in Table 1 for Example 1 are used.

Water, Triton XQS 20 surfactant, 2-acrylamido-2-methylpropanesulfonic acid and potassium persulfate are added to the kettle and agitated until a homogeneous solution is formed. Sodium hydroxide is added to buffer the solution. Charges B, C and D are made up separately. 6.6 Percent of Charge C is added to Charge A. Charge D is then added to the remainder of Charge C. The kettle is heated to 80° C and its contents are agitated and Charge B and combined Charges C and D are added continuously over a 4 hour period. A gentle reflux is maintained throughout the polymerization. The resulting latex contains 48.2 weight percent polymer, has a pH of 4.4 and a Brookfield viscosity of 1360 cps. at 25° C. The coagulum is 0.02 weight percent. The interpolymer has a specific viscosity of 2 in dimethyl sulfoxide at a concentration of 1 g per 100 ml and a temperature of 25° C. The properties of the latex are tabulated in Table 1.

EXAMPLES 2–5

Examples 2–5 are prepared by the process set forth above for Example 1. The resulting latices have solids contents of approximately 48 percent and viscosities in the range of 150 to 500 cps. The data are tabulated in Table 1 with the data for Example 1. Examples 1 and 2 are within the scope of the invention and demonstrate the higher viscosity of the latex and low degree of coagulum formation obtained with the interpolymers of the present invention. Examples 3 and 4 contain lesser amounts of 2-acrylamido-2-methylpropanesulfonic acid and Example 5 contains no AMPS comonomer and demonstrate the lower viscosity of the latex and the higher degree of coagulum formation when the AMPS content is reduced or AMPS is omitted entirely.

TABLE 1

PREPARATION AND PROPERTIES OF VINYL ACETATE INTERPOLYMER LATICES

| Charge A (pbw) | Ex. 1 | Ex. 2 | Ex. 3 | Ex. 4 | Ex. 5 |
|---|---|---|---|---|---|
| Water | 46.29 | 46.29 | 47.8 | 47.8 | 47.9 |
| NaOH | 0.16 | 0.16 | 0.11 | 0.13 | 0.10 |
| Triton XQS 20 | 1.54 | 1.54 | 1.24 | 1.54 | 1.55 |
| AMPS | 0.11 | 0.11 | 0.08 | 0.065 | 0 |
| $K_2S_2O_8$ | 0.17 | 0.17 | 0.17 | 0.17 | 0.17 |
| Charge B | | | | | |
| Water | 4.54 | 4.54 | 2.1 | 2.1 | 2.1 |
| $K_2S_2O_8$ | 0.08 | 0.08 | 0.02 | 0.02 | 0.02 |

TABLE 1-continued

PREPARATION AND PROPERTIES OF VINYL ACETATE INTERPOLYMER LATICES

| Charge A (pbw) | Ex. 1 | Ex. 2 | Ex. 3 | Ex. 4 | Ex. 5 |
|---|---|---|---|---|---|
| Charge C | | | | | |
| Vinyl Acetate | 44.23 | 43.5 | 43.7 | 43.7 | 43.7 |
| Aerosol MA | 0.45 | 0.45 | 0.45 | 0.45 | 0.46 |
| Acrylic Acid | 0.25 | 0.32 | 0.33 | 0.33 | 0.33 |
| Charge D | | | | | |
| Acrylic Acid | 2.31 | 2.95 | 2.96 | 2.96 | 2.95 |
| Monomer Weight Ratio | | | | | |
| Vinyl Acetate | 94.30 | 92.80 | 92.84 | 92.88 | 93.02 |
| Acrylic Acid | 5.45 | 6.97 | 6.98 | 6.99 | 6.98 |
| AMPS | 0.25 | 0.23 | 0.17 | 0.13 | 0 |
| Latex Solids, Weight Percent | 48.2 | 48.3 | 47.0 | 47.9 | 48.1 |
| Viscosity (cps. 25° C.) | 1360 | 450 | 550 | 190 | 150 |
| Coagulum, (% of interpolymer) | 0.02 | 0.02 | 0.11 | 0.02 | 0.33 |

PART B — TESTING OF LATEX INTERPOLYMERS

The latex interpolymers are tested for tensile strength and elongation according to ASTM Method D-882-67 on films of interpolymer cast from aqueous solutions neutralized with sodium carbonate. The test specimens are conditioned at 65% relative humidity. Polyester adhesion is determined by measuring the load in kilograms required to break 2.54 × 1.27 cm. Mylar polyester film lap joints adhered with a film of interpolymer of 51 micron thickness. Experience has shown that adhesion values of at least about 36 kilograms are required for satisfactory performance as a size on spun polyester woven on a commercial loom. Data for the interpolymers are presented in Table II in comparison with data for starch, polyvinyl alcohol and carboxymethylcellulose and demonstrate the vastly superior adhesion of the interpolymers although they are in general lower in tensile strength.

Solubility in aqueous solvent is determined on films of interpolymer of 127 micron thickness cast from an aqueous sodium carbonate solution of the interpolymer. Samples of film 5.08 × 2.54 cm. in size are weighed. The samples are immersed in 100 g. of water and stirred with a magnetic stirrer at a rate sufficient to create a slight vortex. The time taken for the samples to dissolve in water at 80° ± 2° C. is determined. Based on the assumption that the rate of solution is constant over the time taken for solution, rates are calculated and are given as milligrams per square centimeter minute.

The data for Examples 1 and 2 which are within the scope of the present invention are presented in Table II in comparison with the data for Examples 3, 4 and 5 which are outside the scope of the invention and the data for starch, polyvinyl alcohol and carboxymethylcellulose. The comparison illustrates the surprising superiority of the interpolymers of the present invention in rate of solution and hence in rate of removability from woven goods prepared from yarn sized with the interpolymers.

TABLE II

COMPARISON OF SIZE RESINS

| | Tensile Strength kg/cm² | Elongation % | Polyester Adhesion kg. | Solubility Rate mg/cm² min. |
|---|---|---|---|---|
| Example 1 | 110 | 400 | 113 | 50 |
| Example 2 | 98 | 380 | 117 | 31 |
| Example 3 | 128 | 465 | 82 | 10 |
| Example 4 | 110 | 500 | 134 | 11 |
| Example 5 | 118 | 400 | 100 | 11 |

TABLE II-continued

COMPARISON OF SIZE RESINS

| | Tensile Strength kg/cm² | Elongation % | Polyester Adhesion kg. | Solubility Rate mg/cm² min. |
|---|---|---|---|---|
| Starch | — | — | 0 | 0 |
| PVOH | 460 | 240 | 23 | 2.5 |
| CMC | 655 | 39 | 14 | 9–10 |

EXAMPLE 6

An aqueous size solution is prepared by adding 200 parts by weight of the interpolymer latex of Example 1, 5 parts by weight of anhydrous sodium carbonate, 9 parts of mill wax and 1 part of defoamer to 1600 parts of water and the solution is held at 88° C. 1500 Meters of 20/1 50/50 spun polyester/cotton yarn is sized with the solution on a 10-can West Point Slasher at a rate of 82 meters per minute and a can temperature of 135° C. achieving an add-on of 11 percent. The warp is woven into a corduroy fabric on a DSL loom at 187 picks per minute using 15/1 cotton ground and 15/1 pile warps. The warp weaves at 98.6 percent efficiency. The fabric is readily desized with water.

The weaving efficiency is a measure of efficiency of weaving of the sized warp yarn into a cloth or sheet construction. It is expressed as a percentage ratio of the number of meters woven in unit time versus the number of meters which would be woven if the loom had no stops in the unit of time.

EXAMPLE 7

An aqueous size solution is prepared by dissolving 60 parts by weight of a polyvinyl alcohol sold by E. I. duPont de Nemours and Co. under the trade name Elvanol T-25, 125 parts by weight of the interpolymer latex of Example 1, 3 parts by weight of anhydrous sodium carbonate, 10 parts by weight of mill wax and 1 part by weight of defoamer in 1450 parts by weight of water. Slashing is carried out with the yarn of Example 6 and in the manner described in Example 6. The size add-on is 10.9 percent. Weaving efficiency under the conditions of Example 6 is 98.2 percent. The fabric is readily desized by scouring with water.

EXAMPLE 8

The procedure of Example 6 is repeated with an aqueous solution of Elvanol T-25 polyvinyl alcohol to provide a warp yarn with 11 percent add-on, and a corduroy fabric is woven therefrom.

EXAMPLE 9

This example sets forth a comparison of the desizing of the sized fabrics obtained in Examples 6, 7 and 8. The fabrics are padded at room temperature with a dilute aqueous solution containing 1.7 parts sodium hydroxide and 1 part of nonionic detergent on the weight of the fabric. They are then steamed in open width for 45 seconds and scoured for 10 minutes at 85° C. in 0.02 percent aqueous nonionic detergent solution, rinsed and dried. Size residues are revealed by application of a dilute iodine solution to the desized fabric. The iodine associates with vinyl acetate interpolymer and polyvinyl alcohol to produce a red coloration on the fabric. The test reveals no staining of the fabrics of Examples 6, 7 and 8 and therefore complete removal of the size when the fabrics are not heat set. However, when the fabrics are subjected to heat set for times up to 60 seconds at 205° C., a common commercial practice, and then desized by the above procedure, no staining of the fabric of Example 6 by iodine is observed. The fabric of Example 7 shows no staining when the time of heat set is less than 30 seconds. The fabric of Example 8 shows staining after a heat set of only ten seconds and demonstrates the poorer removability of polyvinyl alcohol compared with the interpolymer of the present invention and compared with a combination size containing polyvinyl alcohol and the interpolymer.

What is claimed is:

1. A textile sizing solution which comprises a vinyl acetate interpolymer and a water dispersible polymer selected from the group consisting of polyvinyl alcohol and starch wherein the interpolymer comprises from about 64.5 to about 95.0 weight percent of vinyl acetate, from about 4.0 to about 9.5 weight percent of acrylic acid, from about 0.2 to about 1 weight percent of 2-acrylamido-2-methylpropanesulfonic acid and from about 0 to about 25 weight percent of an ethylenically unsaturated monomer selected from the group consisting of alkyl acrylates, dialkyl maleates and dialkyl fumarates wherein the alkyl groups contain from 1 to 8 carbon atoms and wherein the weight ratio of the interpolymer to the water dispersible polymer is in the range of about 95:5 to about 5:95.

2. The sizing solution as in claim 1 wherein the ethylenically unsaturated monomer is selected from the group consisting of methyl acrylate, ethyl acrylate, butyl acrylate, 2-ethylhexyl acrylate, dimethyl maleate, diethyl maleate, dibutyl maleate, di-2-ethylhexyl maleate, dimethyl fumarate, diethyl fumarate, dibutyl fumarate and di-2-ethylhexyl fumarate.

3. The sizing solution as in claim 1 wherein the interpolymer in dimethyl sulfoxide at a concentration of 1 gram per 100 ml. has a specific viscosity in the range from about 1.5 to about 12 at 25° C.

4. The sizing solution as in claim 1 comprising from about 1 to about 25 weight percent of interpolymer and polymer.

5. A method for sizing textiles which comprises applying to the textile material an aqueous solution of a vinyl acetate interpolymer and a water dispersible polymer selected from the group consisting of polyvinyl alcohol and starch wherein the interpolymer comprises from about 64.5 to about 95.8 weight percent of vinyl acetate, from about 4.0 to about 9.5 weight percent of acrylic acid, from about 0.2 to about 1 weight percent of 2-acrylamido-2-methylpropanesulfonic acid and from about 0 to about 25 weight percent of an ethylenically unsaturated monomer selected from the group consisting of alkyl acrylates, dialkyl maleates and dialkyl fumarates wherein the alkyl groups contain from 1 to 8 carbon atoms and wherein the weight ratio of the interpolymer to the water dispersible polymer is in the range of about 95:5 to about 5:95.

6. The method of claim 5 wherein the interpolymer is obtained by latex interpolymerization.

7. The method as in claim 5 wherein the ethylenically unsaturated monomer is selected from the group consisting of methyl acrylate, ethyl acrylate, butyl acrylate, 2-ethylhexyl acrylate, dimethyl maleate, diethyl maleate, dibutyl maleate, di-2-ethylhexyl maleate, dimethyl fumarate, diethyl fumarate, dibutyl fumarate and di-2-ethylhexyl fumarate.

8. The method as in claim 5 wherein the interpolymer in dimethyl sulfoxide at a concentration of 1 gram per 100 ml. has a specific viscosity in the range of from about 1.5 to about 12.0 at 25° C.

9. The method as in claim 5 wherein the size contains from about 1 to about 25 weight percent of interpolymer and polymer.

10. A sized textile material wherein the size comprises a vinyl acetate interpolymer and a water dispersible polymer selected from the group consisting of polyvinyl alcohol and starch, wherein the interpolymer comprises from about 64.5 to about 95.8 weight percent of vinyl acetate, from about 4.0 to about 9.5 weight percent of acrylic acid, from about 0.2 to about 1.0 weight percent of 2-acrylamido-2-methylpropanesulfonic acid and from about 0 to about 25 weight percent of an ethylenically unsaturated monomer selected from the group consisting of alkyl acrylate, dialkyl maleates and dialkyl fumarates wherein the alkyl groups contain from 1 to 8 carbon atoms and wherein the weight ratio of the interpolymer to the water dispersible polymer is in the range of about 95:5 to about 5:95.

11. The sized textile material as in claim 10 wherein the ethylenically unsaturated monomer is selected from the group consisting of methyl acrylate, ethyl acrylate, butyl acrylate, 2-ethylhexyl acrylate, dimethyl maleate, diethyl maleate, dibutyl maleate, di-2-ethylhexyl maleate, dimethyl fumarate, diethyl fumarate, dibutyl fumarate and di-2-ethylhexyl fumarate.

12. The sized textile material as in claim 10 wherein the textile material is a yarn of spun polyester or spun polyester blended with natural fiber.

* * * * *